United States Patent [19]

Bretz et al.

[11] Patent Number: 4,797,165

[45] **Date of Patent: * Jan. 10, 1989**

[54] ALUMINUM-LITHIUM ALLOYS HAVING IMPROVED CORROSION RESISTANCE AND METHOD

[75] Inventors: Philip E. Bretz, Plum Boro; Ralph R. Sawtell, Pittsburgh; Warren H. Hunt, Jr., Monroeville, all of Pa.

[73] Assignee: Aluminum Company of America, Pittsburgh, Pa.

[ * ] Notice: The portion of the term of this patent subsequent to Mar. 10, 2004 has been disclaimed.

[21] Appl. No.: 685,731

[22] Filed: Dec. 24, 1984

Related U.S. Application Data

[63] Continuation-in-part of Ser. No. 594,344, Mar. 29, 1984, Pat. No. 4,648,913.

[51] Int. Cl.[4] ..... C22F 1/04

[52] U.S. Cl. ..... 148/12.7 A; 148/415; 148/416; 148/417

[58] Field of Search ..... 148/11.5 A, 12.7 A, 148/2, 415, 416, 417, 418, 437, 438, 439, 440

[56] References Cited

U.S. PATENT DOCUMENTS 4,648,913 3/1987 Hunt, Jr. et al. ..... 148/12.7 A

*Primary Examiner*—Dean R.

*Attorney, Agent, or Firm*—Andrew Alexander

[57] ABSTRACT

An aluminum base alloy wrought product having improved corrosion resistance in addition to combinations of strength and toughness. The product comprises 2.2 to 3.0 wt. % Li, 0.4 to 2.0 wt. % Mg, 0.2 to 1.6 wt. % Cu, 0 to 2.0 wt. % Mn, 0.5 wt. % max. Fe, 0.5 wt. % max. Si, the balance aluminum and incidental impurities and has the ability to develop improved combinations of strength and toughness in response to an aging treatment. Prior to an aging step, the product having imparted thereto a working effect equivalent to stretching so that after an aging step it has improved combinations of strength and toughness.

30 Claims, 5 Drawing Sheets

R-CURVE TOUGHNESS VS. YIELD STRENGTH

R-CURVE TOUGHNESS VS. YIELD STRENGTH

R-CURVE TOUGHNESS VS. YIELD STRENGTH

EFFECT OF STRETCH ON TEAR/YIELD RATIO

EFFECT OF STRETCH ON TEAR/YIELD RATIO

EFFECT OF STRETCH ON LONG-TRANSVERSE TOUGHNESS

TEAR STRENGTH - YIELD STRENGTH RATIO VS YIELD STRENGTH FOR 2024

ALUMINUM-LITHIUM ALLOYS HAVING IMPROVED CORROSION RESISTANCE AND METHOD

CROSS REFERENCE TO RELATED APPLICATIONS is a continuation-in-part of U.S. Application Ser. No. 594,344, filed Mar. 29, 1984 U.S. Pat. No. 4,648,913.

BACKGROUND OF THE INVENTION

This invention relates to aluminum base alloy products, and more particularly, it relates to improved lithium containing aluminum base alloy products having improved corrosion resistance and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

The present invention provides an improved lithium containing aluminum base alloy product which can be processed to improve strength characteristics while retaining high toughness properties or which can be processed to provide a desired strength at a controlled level of toughness.

SUMMARY OF THE INVENTION

A principal object of this invention is to provide a lithium containing aluminum base alloy product having improved corrosion resistance.

Another object of this invention is to provide an improved aluminm-lithium alloy wrought product having improved corrosion resistance in addition to strength and toughness characteristics.

Yet another object of this invention is to provide an aluminum-lithium alloy product having improved corrosion resistance and capable of being worked after solution heat treating to improve strength properties without substantially impairing its fracture toughness.

And yet another object of this invention includes a method of providing a wrought aluminum-lithium alloy product having improved corrosion resistance and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

In accordance with these objects, an aluminum base alloy wrought product having improved combinations of strength, fracture toughness and corrosion resistance is provided. The product can be provided in a condition suitable for aging and has the ability to develop improved strength in response to aging treatments without substantially impairing fracture toughness properties or corrosion resistance. The product comprises 2.2 to 3.0 wt. % Li, 0.4 to 2.0 wt. % Mg, 0.2 to 1.6 wt. % Cu, 0 to 2.0 wt. % Mn, 0.5 wt. % max. Fe, 0.5 wt. % max. Si, the balance aluminum and incidental impurities. The product is capable of having imparted thereto a working effect equivalent to stretching so that the product has combinations of improved strength and fracture toughness after aging. In the method of making an aluminum base alloy product having improved combinations of strength, fracture toughness and corrosion resistance, a body of a lithium containing aluminum base alloy is provided and may be worked to produce a wrought aluminum product. The wrought product may be first solution heat treated and then stretched or otherwise worked amount equivalent to stretching. The degree of working as by stretching, for example, is normally greater than that used for relief of residual internal quenching stresses.

DETAILED DESCRIPTION OF THE PREFERRED EMBODIMENTS

Figure 1:
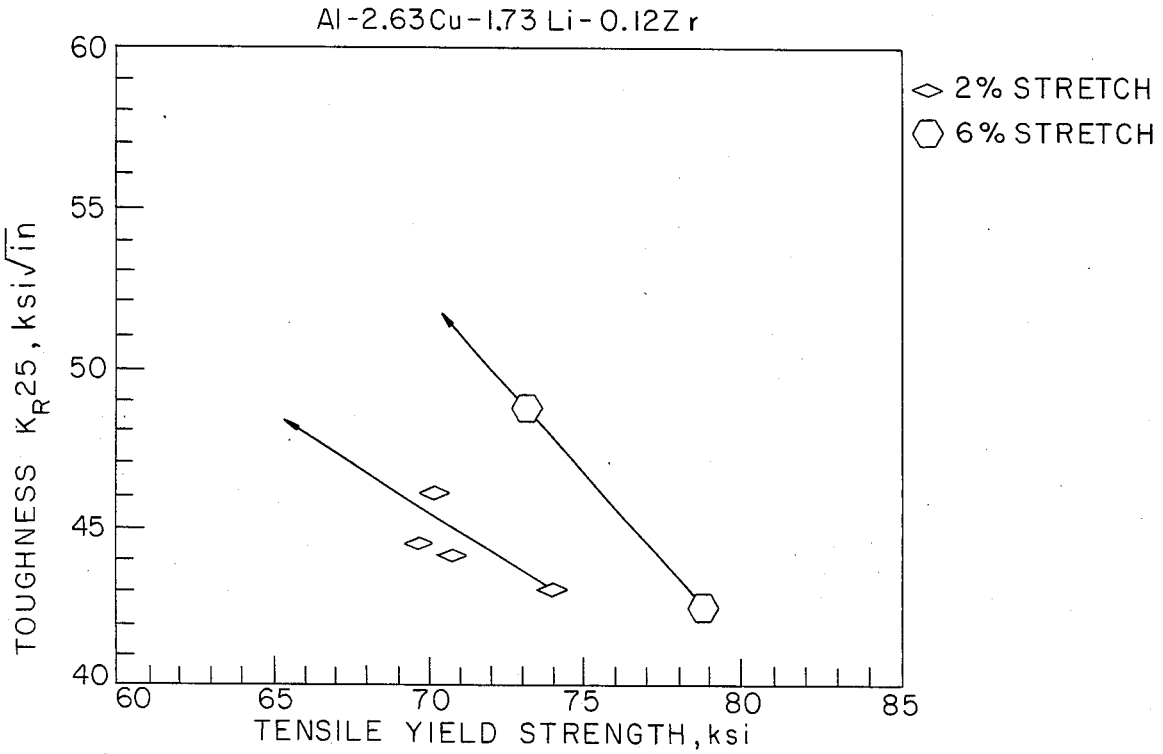
FIG. 1 shows that the relationship between toughness and yield strength for a worked alloy product in accordance with the present invention is increased by stretching.

The alloy of the present invention can contain 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 1.0 to 4.0 wt. % Li, 0.1 to 5.0 wt. % Cu, 0 to 5.0 wt. % Mg, 0 to 1.0 wt. % Zr, 0 to 2.0 wt. % Mn, the balance aluminum and impurities as specified above. A typical alloy composition would contain 2.0 to 3.0 wt. % Li, 0.5 to 4.0 wt. % Cu, 0 to 3.0 wt. % Mg, 0 to 0.2 wt. % Zr, 0 to 1.0 wt. % Mn and max. 0.1 wt. % of each of Fe and Si.

When improved corrosion resistance is required in addition to improved combinations of strength and toughness, the alloy of the present invention must contain 2.2 to 3.0 wt. % Li, 0.4 to 2.0 wt. % Mg, 0.2 to 1.6 wt. % Cu, 0 to 2.0 wt. % Mn, 0.5 wt. % max. Fe, 0.5 wt. % max. Si, 0.01 to 0.2 wt. % Zr, the balance aluminum and incidental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

When it is desired to maximize both fracture toughness and corrosion resistance, a preferred alloy in accordance with the present invention can contain 2.3 to 2.6 wt. % Li, 0.5 to 0.8 wt. % Cu, 1.0 to 1.4 wt. % Mg, 0 to 0.5 wt. % Mn, 0.09 to 0.15 wt. % Zr, the balance aluminum and impurities as specified above.

If it is desired to improve fracture toughness while only slightly diminishing corrosion resistance, a preferred alloy in accordance with the invention can contain 2.2 to 2.4 wt. % Li, 0.8 to 1.2 wt. % Cu, 1.0 to 1.4 wt. % Mg, 0 to 0.5 wt. % Mn, 0.09 to 0.15 wt. % Zr, the balance aluminum and impurities as specified above. A typical alloy composition would contain 2.3 wt. % Li, 1.0 wt. % Cu, 1.1 wt. % Mg, 0.12 wt. % Zr and max. 0.1 wt. % of each of Fe and Si.

To obtain the lowest density while maximizing fracture toughness and corrosion resistance, then preferably the alloy composition is 2.6 to 3.0 wt. % Li, 0.3 to 0.6 wt. % Cu, 0.8 to 1.2 wt. % Mg, 0 to 1.0 wt. % Mn, 0.09 to 0.15 wt. % Zr, the balance aluminum and impurities as specified above.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

It must be recognized that to obtain a high level of corrosion resistance in addition to the unique combinations of strength and fracture toughness as well as reductions in density requires careful selection of all the alloying elements. For example, for every 1 wt. % Li added, the density of the alloy is decreased about 2.4%. Thus, if density is the only consideration, then the amount of Li would be maximized. However, if it is desired to increase toughness at a given strength level, then Cu should be added. However, for every 1 wt. % Cu added to the alloy, the density is increased by 0.87% and resistance to corrosion and stress corrosion cracking is reduced. Likewise, for every 1 wt. % Mn added, the density is increased about 0.85%. Thus, care must be taken to avoid losing the benefits of lithium by the addition of alloying elements such as Cu and Mn, for example. Accordingly, while lithium is the most important element for saving weight, the other elements are important in order to provide the proper levels of strength, fracture toughness, corrosion and stress corrosion cracking resistance.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness. In addition, higher levels of copper can result in diminished resistance to corrosion and to stress corrosion cracking. Thus, in accordance with this invention, it has been discovered that adhering to the ranges set forth above for copper, fracture toughness, strength, corrosion and stress corrosion cracking can be maximized, as illustrated in FIG. 8.

Figure 8:
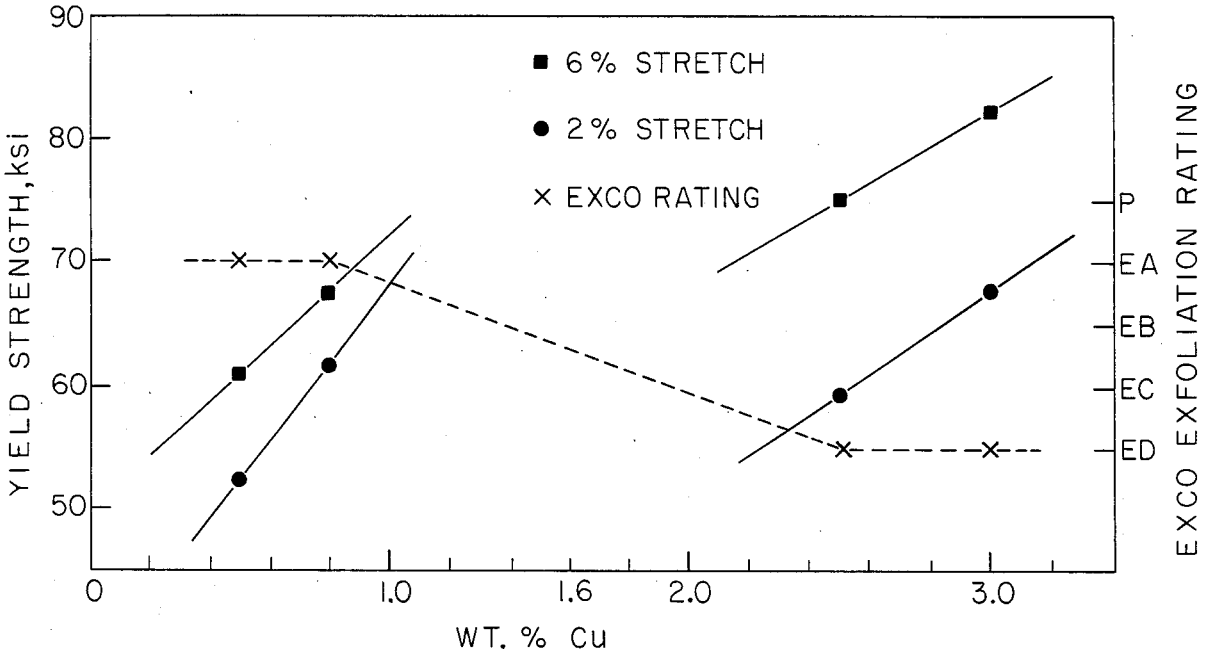
FIG. 8 illustrates corrosion resistance and strength as a function of alloy composition.

The effect of a copper on strength is shown in FIG. 8 at 2 and 6stretching. In addition, there is shown the deleterious effect of greater amounts of copper on corrosion resistance. That is, there is shown that greater strengths are obtained with greater amounts of copper but that corrosion resistance is lowered and that at lower amounts of copper, corrosion resistance is improved but strengths are lowered.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

The amount of manganese should also be closely controlled. Manganese is added to contribute to grain structure control, particularly in the final product. Manganese is also a dispersoid-forming element and is precipitated in small particle form by thermal treatments and has as one of its benefits a strengthening effect. Dispersoids such as $Al_{20}Cu_2Mn_3$ and $Al_{12}Mg_2Mn$ can be formed by manganese. Chromium can also be used for grain structure control but on a less preferred basis. Zirconium is the preferred material for grain structure control. The use of zinc results in increased levels of strength, particularly in combination with magnesium. However, excessive amounts of zinc can impair toughness through the formation of intermetallic phases.

Toughness or fracture toughness as used herein refers to the resistance of a body, e.g. sheet or plate, to the unstable growth of cracks or other flaws.

Figure 7:
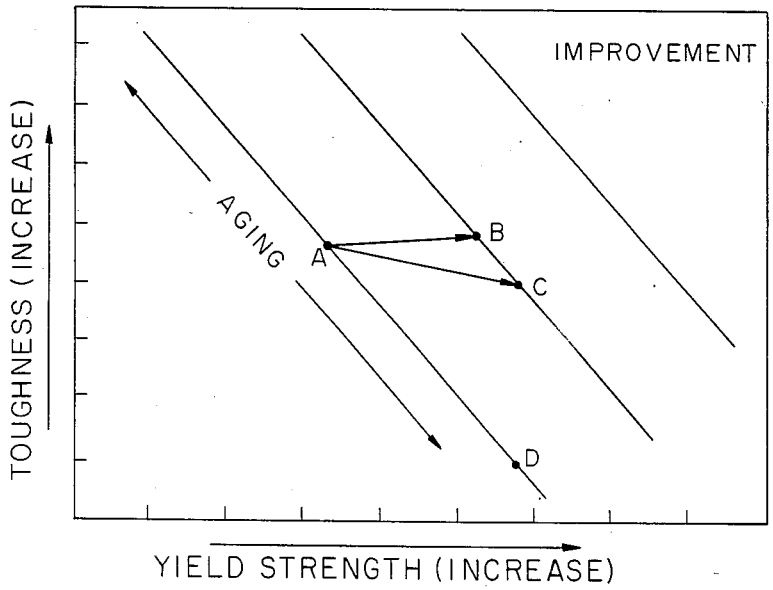
FIG. 7 illustrates different toughness yield strength relationships where shifts in the upward direction and to the right represent improved combinations of these properties.

Improved combinations of strength and toughness is a shift in the normal inverse relationship between strength and toughness towards higher toughness values at given levels of strength or towards higher strength values at given levels of toughness. For example, in FIG. 7, going from point A to point D represents the loss in toughness usually associated with increasing the strength of an alloy. In contrast, going from point A to point B results in an increase in strength at the same toughness level. Thus, point B is an improved combination of strength and toughness. Also, going from point A to point C results in an increase in strength while toughness is decreased, but the combination of strength and toughness is improved relative to point A. However, relative to point D, at point C, toughness is improved and strength remains about the same, and the combination of strength and toughness is considered to be improved. Also, taking point B relative to point D, toughness is improved and strength has decreased yet the combination of strength and toughness are again considered to be improved.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about ¼ to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours, however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal can be rolled or extruded or otherwise subjected to working operations to produce stock such as sheet, plate or extrusions or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F. Preferably, the metal temperature initially is in the range of 900° to 975° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.10 inch.

After rolling a body of the alloy to the desired thickness, the sheet or plate or other worked article is subjected to a solution heat treatment to dissolve soluble elements. The solution heat treatment is preferably accomplished at a temperature in the range of 900° to 1050° F. and preferably produces an unrecrystallized grain structure.

Solution heat treatment can be performed in batches or continuously, and the time for treatment can vary from hours for batch operations down to as little as a few seconds for continuous operations. Basically, solution effects can occur fairly rapidly, for instance in as little as 30 to 60 seconds, once the metal has reached a solution temperature of about 1000 to 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature, and accordingly, solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times.

To further provide for the desired strength and fracture toughness, as well as corrosion resistance, necessary to the final product and to the operations in forming that product, the product should be rapidly quenched to prevent or minimize uncontrolled precipitation of strengthening phases referred to herein later. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some or all of the steps referred to hereinabove, and such is contemplated within the purview of the invention.

Figure 5:
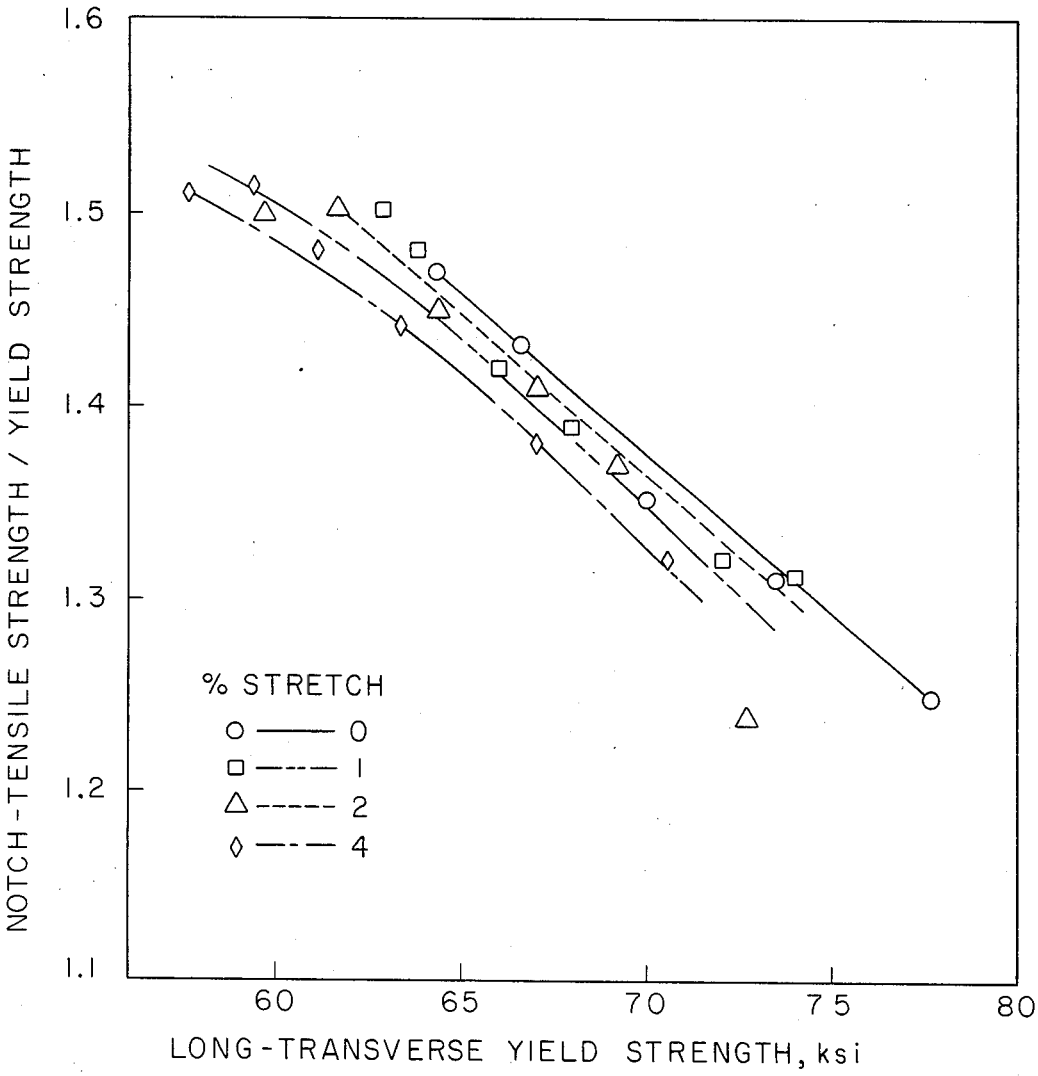
FIG. 5 shows that the relationship between toughness (notch-tensile strength divided by yield strength) and yield strength decreases with increase amounts of stretching for AA7050.
Figure 6:
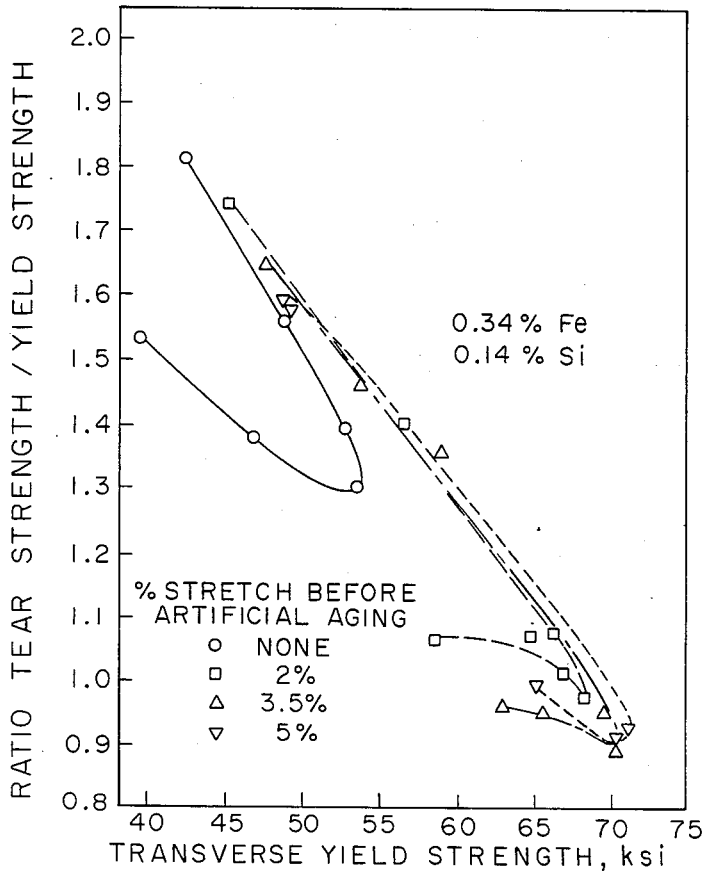
FIG. 6 shows that stretching AA2024 beyond 2% does not significantly increase the toughness-strength relationship for this alloy.

After solution heat treatment and quenching as noted herein, the improved sheet, plate or extrusion and other wrought products can have a range of yield strength from about 25 to 50 ksi and a level of fracture toughness in the range of about 50 to 150 ksi in. However, with the use of artificial aging to improve strength, fracture toughness can drop considerably. To minimize the loss in fracture toughness associated in the past with improvement in strength, it has been discovered that the solution heat treated and quenched alloy product, particularly sheet, plate or extrusion, must be stretched, preferably at room temperature, an amount greater than 3%, e.g. about 3.5% or greater, of its original length or otherwise worked or deformed to impart to the product a working effect equivalent to stretching greater than 3%, e.g. about 3.5% or greater, of its original length. The working effect referred to is meant to include rolling and forging as well as other working operations. It has been discovered that the strength of sheet or plate, for example, of the subject alloy can be increased substantially by stretching prior to artificial aging, and such stretching causes little or no decrease in fracture toughness. It will be appreciated that in comparable high strength alloys, stretching can produce a significant drop in fracture toughness. Stretching AA7050 reduces both toughness and strength, as shown in FIG. 5, taken from the reference by J. T. Staley, mentioned previously. Similar toughness-strength data for AA2024 are shown in FIG. 6. For AA2024, stretching 2% increases the combination of toughness and strength over that obtained without stretching; however, further stretching does not provide any substantial increases in toughness. Therefore, when considering the toughness-strength relationship, it is of little benefit to stretch AA2024 more than 2%, and it is detrimental to stretch AA7050. In contrast, when stretching or its equivalent is combined with artificial aging, an alloy product in accordance with the present invention can be obtained having significantly increased combinations of fracture toughness and strength.

While the inventors do not necessarily wish to be bound by any theory of invention, it is believed that deformation or working, such as stretching, applied after solution heat treating and quenching, results in a more uniform distribution of lithium-containing metastable precipitates after artificial aging. These metastable precipitates are believed to occur as a result of the introduction of a high density of defects (dislocations, vacancies, vacancy clusters, etc.) which can act as preferential nucleation sites for these precipitating phases (such as $T_1'$, a precursor of the $Al_2CuLi$ phase) throughout each grain. Additionally, it is believed that this practice inhibits nucleation of both metastable and equilibrium phases such as $Al_3Li$, AlLi, $Al_2CuLi$ and $Al_5CuLi_3$ at grain and sub-grain boundaries. Also, it is believed that the combination of enhanced uniform precipitation throughout each grain and decreased grain boundary precipitation results in the observed higher combination of strength and fracture toughness in aluminum-lithium alloys worked or deformed as by stretching, for example, prior to final aging.

In the case of sheet or plate, for example, it is preferred that stretching or equivalent working is greater than 3%, e.g. about 3.6% or greater, and less than 14%. Further, it is preferred that stretching be in the range of about 3.7 or 4 to 12% increase over the original length with typical increases being in the range of 5 to 8%.

When the ingot of the alloy is roll cast or slab cast, the cast material may be subjected to stretching or the equivalent thereof without the intermediate steps or with only some of the intermediate steps to obtain strength and fracture toughness in accordance with the invention.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 95 ksi. However, the useful strengths are in the range of 50 to 85 ksi and corresponding fracture toughnesses are in the range of 25 to 75 ksi in. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

The following examples are further illustrative of the invention:

EXAMPLE I

An aluminum alloy consisting of 1.73 wt. % Li, 2.63 wt. % Cu, 0.12 wt. % Zr, the balance essentially aluminum and impurities, was cast into an ingot suitable for rolling. The ingot was homogenized in a furnace at a temperature of 1000° F. for 24 hours and then hot rolled into a plate product about one inch thick. The plate was then solution heat treated in a heat treating furnace at a temperature of 1025° F. for one hour and then quenched by immersion in 70° F. water, the temperature of the plate immediately before immersion being 1025° F. Thereafter, a sample of the plate was stretched 2% greater than its original length, and a second sample was stretched 6% greater than its original length, both at about room temperature. For purposes of artificially aging, the stretched samples were treated at either 325° F. or 375° F. for times as shown in Table I. The yield strength values for the samples referred to are based on specimens taken in the longitudinal direction, the direction parallel to the direction of rolling. Toughness was determined by ASTM Standard Practice E561-81 for R-curve determination. The results of these tests are set forth in Table I. In addition, the results are shown in FIG. 1 where toughness is plotted against yield strength. It will be noted from FIG. 1 that 6% stretch displaces the strength-toughness relationship upwards and to the right relative to the 2% stretch. Thus, it will be seen that stretching beyond 2% substantially improved toughness and strength in this lithium containing alloy. In contrast, stretching decreases both strength and toughness in the long transverse direction for alloy 7050 (FIG. 5). Also, in FIG. 6, stretching beyond 2% provides added little benefit to the toughness-strength relationship in AA2024.

TABLE I

| Aging Practice | | 2% Stretch | | 6% Stretch | |
|---|---|---|---|---|---|
| hrs. | °F. | Tensile Yield Strength, ksi | $K_R25$, ksi in. | Tensile Yield Strength, ksi | $K_R25$, ksi in. |
| 16 | 325 | 70.2 | 46.1 | 78.8 | 42.5 |
| 72 | 325 | 74.0 | 43.1 | — | — |
| 4 | 375 | 69.6 | 44.5 | 73.2 | 48.7 |
| 16 | 375 | 70.7 | 44.1 | — | — |

EXAMPLE II

Figure 2:
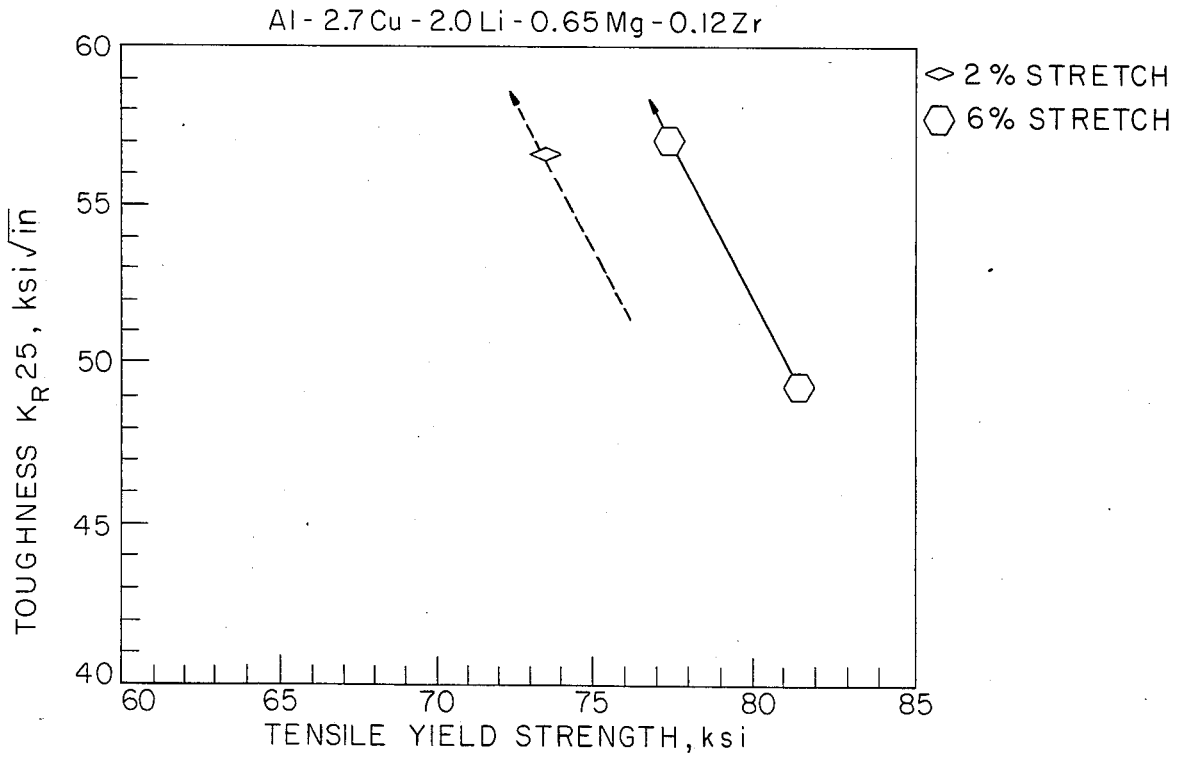
FIG. 2 shows that the relationship between toughness and yield strength is increased for a second worked alloy product stretched in accordance with the present invention.
Figure 3:
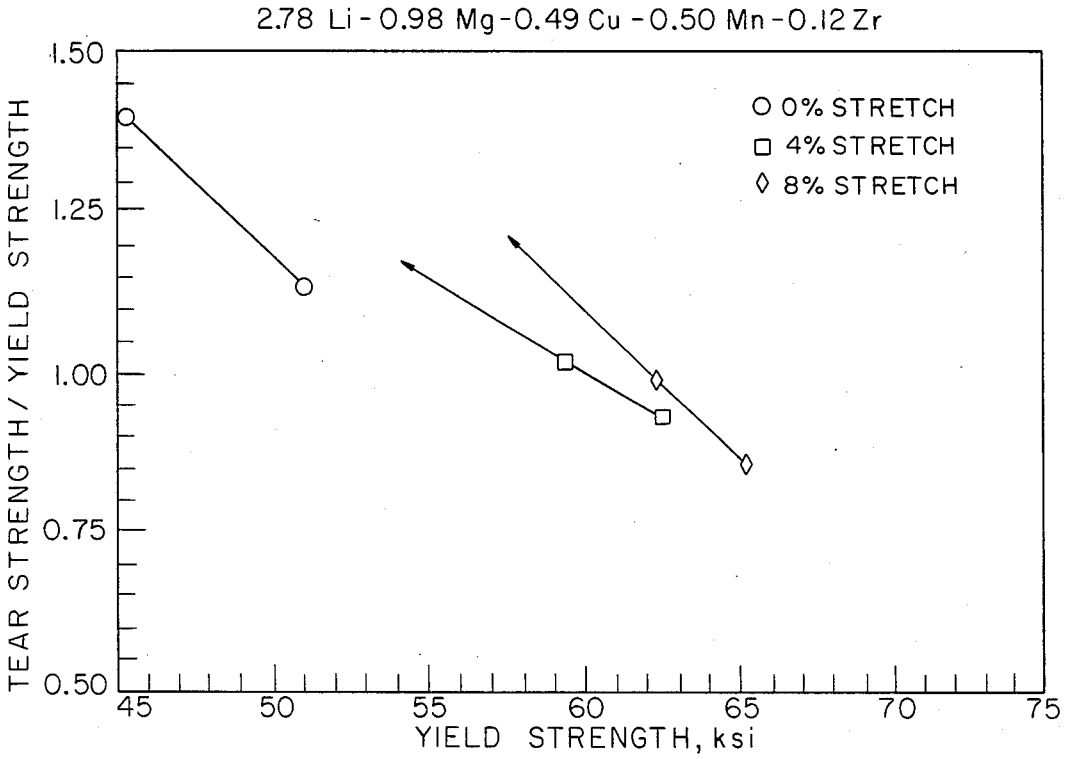
FIG. 3 shows the relationship between toughness and yield strength of a third alloy product stretched in accordance with the present invention.

An aluminum alloy consisting of, by weight, 2.0% Li, 2.7% Cu, 0.65% Mg and 0.12% Zr, the balance essentially aluminum and impurities, was cast into an ingot suitable for rolling. The ingot was homogenized at 980° F. for 36 hours, hot rolled to 1.0 inch plate as in Example I, and solution heat treated for one hour at 980° F. Additionally, the specimens were also quenched, stretched, aged and tested for toughness and strength as in Example I. The results are provided in Table II, and the relationship between toughness and yield strength is set forth in FIG. 2. As in Example I, stretching this alloy 6% displaces the toughness-strength relationship to substantially higher levels. The dashed line through the single data point for 2% stretch is meant to suggest the probable relationship for this amount of stretch.

TABLE II

| Aging Practice | | 2% Stretch | | 6% Stretch | |
|---|---|---|---|---|---|
| hrs. | °F. | Tensile Yield Strength, ksi | $K_R25$, ksi in. | Tensile Yield Strength, ksi | $K_R25$, ksi in. |
| 48 | 325 | — | — | 81.5 | 49.3 |
| 72 | 325 | 73.5 | 56.6 | — | — |
| 4 | 375 | — | — | 77.5 | 57.1 |

EXAMPLE III

An aluminum alloy consisting of, by weight, 2.78% Li, 0.49% Cu, 0.98% Mg, 0.50 Mn and 0.12% Zr, the balance essentially aluminum, was cast into an ingot suitable for rolling. The ingot was homogenized as in Example I and hot rolled to plate of 0.25 inch thick. Thereafter, the plate was solution heat treated for one hour at 1000° F. and quenched in 70° water. Samples of the quenched plate were stretched 0%, 4% and 8% before aging for 24 hours at 325° F. or 375° F. Yield strength was determined as in Example I and toughness was determined by Kahn type tear tests. This test procedure is described in a paper entitled "Tear Resistance of Aluminum Alloy Sheet as Determined from Kahn-Type Tear Tests", *Materials Research and Standards*, Vol. 4, No. 4, 1984 April, p. 181. The results are set forth in Table III, and the relationship between toughness and yield strength is plotted in FIG. 5.

Here, it can be seen that stretching 8% provides increased strength and toughness over that already gained by stretching 4%. In contrast, data for AA2024 stretched from 2% to 5% (FIG. 6) fall in a very narrow band, unlike the larger effect of stretching on the toughness-strength relationship seen in lithium-containing alloys.

TABLE III

| Stretch | Aging Practice hrs. | Aging Practice °F. | Tensile Yield Strength ksi | Tear Strength ksi | Tear Strength/Yield Strength |
|---|---|---|---|---|---|
| 0% | 24 | 325 | 45.6 | 63.7 | 1.40 |
| 4% | 24 | 325 | 59.5 | 60.5 | 1.02 |
| 8% | 24 | 325 | 62.5 | 61.6 | 0.98 |
| 0% | 24 | 375 | 51.2 | 58.0 | 1.13 |
| 4% | 24 | 375 | 62.6 | 58.0 | 0.93 |
| 8% | 24 | 375 | 65.3 | 55.7 | 0.85 |

EXAMPLE IV

Figure 4:
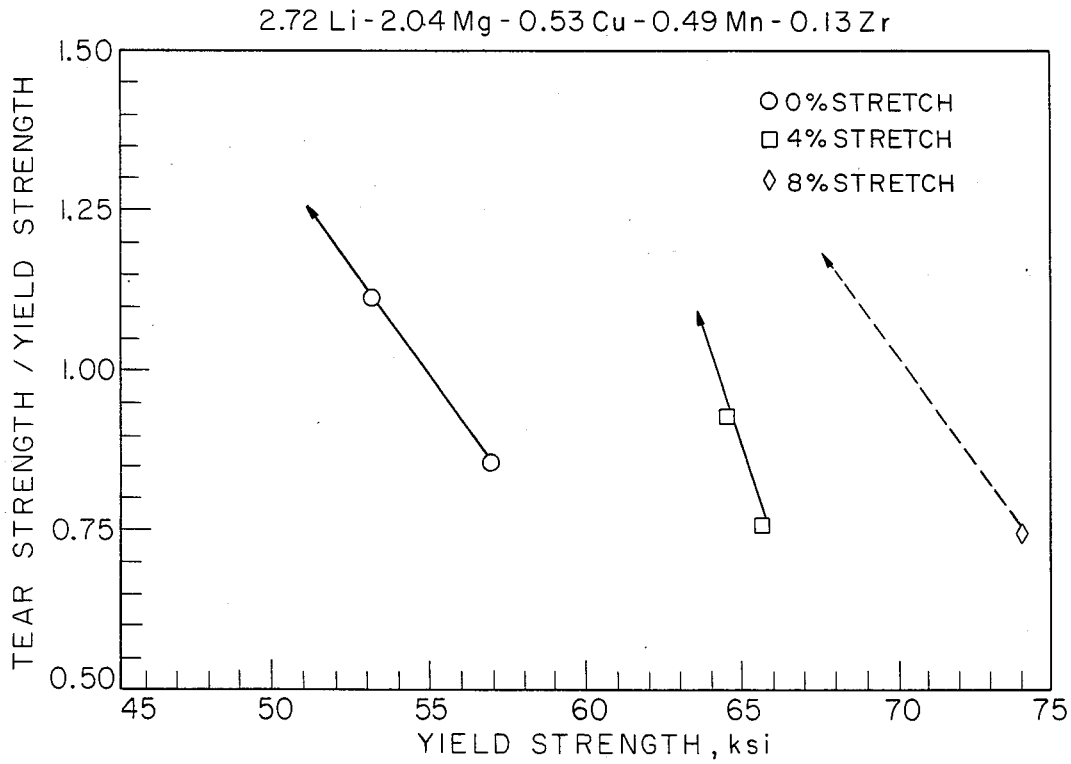
FIG. 4 shows that the relationship between toughness and yield strength is increased for another alloy product stretched in accordance with the present invention.

An aluminum alloy consisting of, by weight, 2.72% Li, 2.04% Mg, 0.53% Cu, 0.49 Mn and 0.13% Zr, the balance essentially aluminum and impurities, was cast into an ingot suitable for rolling. Thereafter, it was homogenized as in Example I and then hot rolled into plate 0.25 inch thick. After hot rolling, the plate was solution heat treated for one hour at 1000° F. and quenched in 70° water. Samples were taken at 0%, 4% and 8% stretch and aged as in Example I. Tests were performed as in Example III, and the results are presented in Table IV. FIG. 4 shows the relationship of toughness and yield strength for this alloy as a function of the amount of stretching. The dashed line is meant to suggest the toughness-strength relationship for this amount of stretch. For this alloy, the increase in strength at equivalent toughness is significantly greater than the previous alloys and was unexpected in view of the behavior of conventional alloys such as AA7050 and AA2024.

TABLE IV

| Stretch | Aging Practice hrs. | Aging Practice °F. | Tensile Yield Strength ksi | Tear Strength ksi | Tear Strength/Yield Strength |
|---|---|---|---|---|---|
| 0% | 24 | 325 | 53.2 | 59.1 | 1.11 |
| 4% | 24 | 325 | 64.6 | 59.4 | 0.92 |
| 8% | 24 | 325 | 74.0 | 54.2 | 0.73 |
| 0% | 24 | 375 | 56.9 | 48.4 | 0.85 |
| 4% | 24 | 375 | 65.7 | 49.2 | 0.75 |

EXAMPLE V

A first aluminum alloy consisting of, by weight, 2.3 Li, 0.5 Cu, 1.2 Mg and 0.12 Zr, the balance essentially aluminum and impurities, was cast into an ingot suitable for rolling. The ingot was homogenized at 1000° F. for 24 hours and then hot rolled into a plate product 0.4 inch thick. The plate was solution heat treated at a temperature of 1000° F., then cold water quenched and stretched 6% greater than its original length. For purposes of artificially aging the stretched samples were treated at 300° to 325° F. for 12 to 48 hours. A second and third aluminum alloy having identical composition except for 1.0 Cu and 2.7 Cu, respectively, were cast and treated in the same manner. Specimens were taken as in Example I and tensile strength, yield strength and fracture toughness, as measured by the Kahn Tear Test, was determined. Also, the samples were tested for exfoliation corrosion and rated according to the EXCO (ASTM test method G34) exfoliation rating where an EA rating indicates a high resistance to exfoliation corrosion and an ED rating indicates a low resistance. The results of the tests are provided in Table V.

TABLE V

| | Strength | | Toughness | Corrosion |
|---|---|---|---|---|
| Alloy | Tensile (ksi) | Yield | UPE | EXCO Rating |
| 1 | 69.5 | 61.4 | 210 | EB |
| 2 | 65.0 | 57.0 | 255 | EC |
| 3 | 66.1 | 61.4 | 405 | EC |

Figure 9:
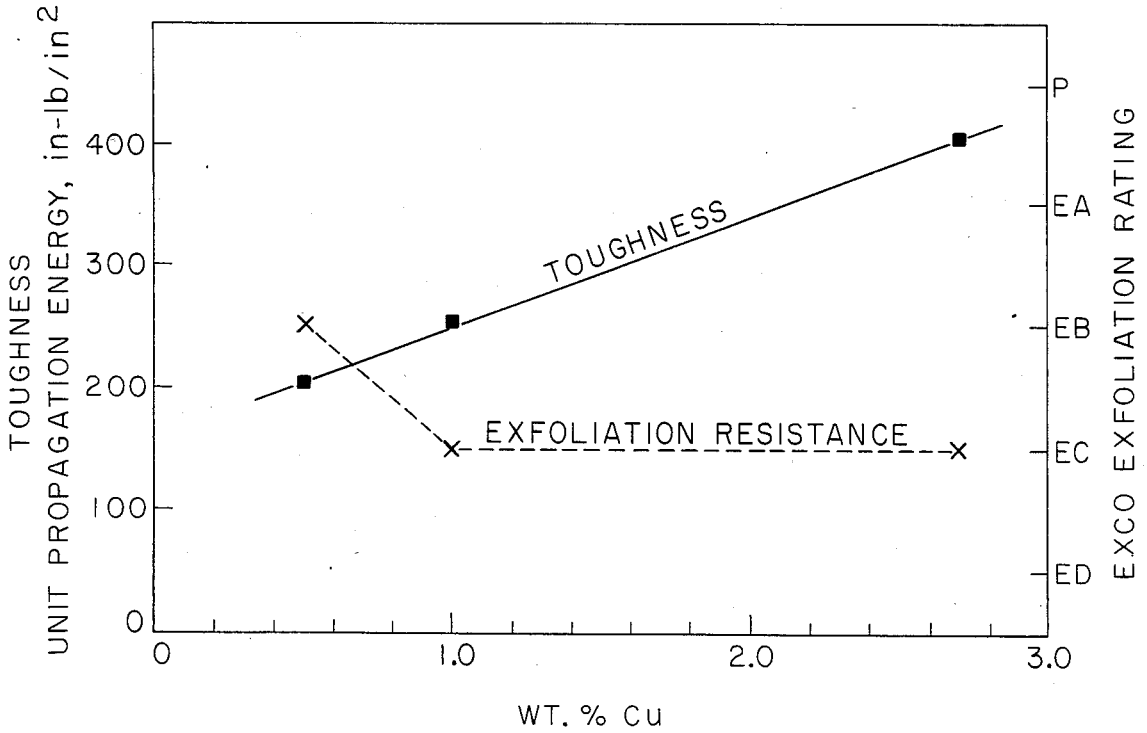
FIG. 9 is a graph showing the effect of copper content on toughness and corrosion.

Toughness and exfoliation resistance as a function of the copper content of the alloy are shown in FIG. 9.

EXAMPLE VI

Four aluminum base alloys were prepared having the following elements:

| Alloy | Li | Cu | Mg | Mn | Zr |
|---|---|---|---|---|---|
| 1 | 2.8 | 0.5 | 1.0 | 0.5 | 0.12 |
| 2 | 2.6 | 0.8 | 1.3 | 0.5 | 0.12 |
| 3 | 2.5 | 2.5 | 0 | 0 | 0.12 |
| 4 | 2.5 | 3.0 | 0 | 0 | 0.12 |

The alloys were cast, homogenized, hot rolled to 0.25 inch plate, solution heat treated and cold water quenched as in Example V. Specimens were taken as in Example V and stretched 2 and 6% of their original length and thereafter artificially aged for 24 hours at 325° F. The samples were tested as in Example V, and the results are provided in Table VI. FIG. 8 shows the relationship of strength and corrosion resistance to the level of copper in the alloys.

TABLE VI

| | Strength at 2% Stretch (ksi) | | Strength at 6% Stretch (ksi) | | EXCO Corrosion |
|---|---|---|---|---|---|
| Alloy | Yield | Tensile | Yield | Tensile | Rating |
| 1 | 52.6 | 65.0 | 61.0 | 67.2 | EA |
| 2 | 61.8 | 74.5 | 67.6 | 77.9 | EA |
| 3 | 59.8 | 75.4 | 75.3 | 85.9 | ED |
| 4 | 67.8 | 81.3 | 82.1 | 88.0 | ED |

It should be noted that alloys 1 and 2, in accordance with the invention, have strengths similar to those of alloys 3 and 4 processed conventionally. Yet, alloys 1 and 2, in accordance with the invention, have far superior corrosion resistance.

While the invention has been described in terms of preferred embodiments, the claims appended hereto are intended to encompass other embodiments which fall within the spirit of the invention.

What is claimed is:

1. An aluminum base alloy wrought product having improved combinations of strength, toughness and corrosion resistance, the product having the ability to develop improved combinations of strength and toughness in response to aging treatment, the product consisting essentially of 2.2 to 3.0 wt. % Li, 0.4 to 2.0 wt. % Mg, 0.2 to 1.6 wt. % Cu, 0 to 2.0 wt. % Mn, 0 to 1.0 wt. % Zr, 0.5 wt. % max. Fe, 0.5 wt. % max. Si, the balance aluminum and incidental impurities, the product having imparted thereto, prior to an aging step, a working effect equivalent to stretching said product an amount greater than about 3.6% and aging the product to provide improved combinations of strength and toughness.

2. The product in accordance with claim 1 wherein the Cu is in the range of 0.3 to 0.8 wt. %.

3. The product in accordance with claim 1 wherein the Mg is in the range of 1.0 to 1.4 wt. %.

4. The product in accordance with claim 1 wherein the Mn is in the range of 0 to 0.5 wt. %.

5. The product in accordance with claim 1 wherein the Li is in the range of 2.4 to 2.8 wt. %.

6. The product in accordance with claim 1 wherein the Li is in the range of 2.2 to 2.4 wt. %.

7. The product in accordance with claim 1 wherein Li is in the range of 2.4 to 3.0 wt. %, Cu is in the range of 0.3 to 0.8 wt. %, Mn is in the range of 0 to 0.5 wt. % and Mg is in the range of 1.0 to 1.4 wt. %.

8. The product in accordance with claim 1 wherein the working effect is equivalent to stretching said product an amount in the range of 3.6 to 14%.

9. The product in accordance with claim 1 wherein the working effect is equivalent to stretching said product an amount in the range of 4 to 12%.

10. The product in accordance with claim 1 wherein the working effect is equivalent to stretching said product an amount in the range of 4 to 8%.

11. The product in accordance with claim 1 wherein the product is stretched an amount in the range of 3.6 to 14%.

12. The product in accordance with claim 1 wherein the product is stretched an amount in the range of 4 to 12%.

13. The product in accordance with claim 1 wherein the product is rolled an amount equivalent to stretching 3.6 to 14%.

14. The product in accordance with claim 1 wherein the product is forged an amount equivalent to stretching 3.6 to 14%.

15. An aluminum base alloy wrought product suitable for aging and having the ability to develop improved combinations of strength and fracture toughness in responnse to an aging treatment, the product consisting essentially of 0.5 to 3.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities, the product having imparted thereto, prior to said aging, a working effect equivalent to stretching an amount 4 to 12% at room temperature and aging said product to provide improved combinations of strength and fracture toughness.

16. An aluminum base alloy wrought product suitable for aging and having the ability to develop improved combinations of strength and fracture toughness in response to an aging treatment, the product consisting essentially of 0.5 to 3.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities, the product, prior to an aging step, stretched 4 to 12% and aging said product to provide improved strength level without a substantial decrease in fracture toughness.

17. Method of making aluminum base alloy products having combinations of improved strength, corrosion resistance and fracture toughness, the method comprising the steps of:

(a) providing a lithium-containing aluminum base alloy product consisting essentially of 2.2 to 3.0 wt. % Li, 0.4 to 2.0 wt. % Mg, 0.2 to 1.6 wt. % Cu, 0 to 2.0 wt. % Mn, 0 to 1.0 wt. % Zr, 0.5 wt. % max. Fe, 0.5 wt. % max. Si, the balance aluminum and incidental impurities, the product having imparted thereto, prior to an aging step, a working effect equivalent to stretching so that after an aging step the product has improved combinations of strength and toughness; and (b) imparting to said product, prior to an aging step, a working effect equivalent to stretching said product an amount greater than about 3.6% at room temperature and aging said product to provide improved combinations of strength and fracture toughness in addition to corrosion resistance.

18. The method in accordance with claim 17 wherein the Cu is in the range of 0.3 to 0.8 wt. %.

19. The method in accordance with claim 17 wherein the Mg is in the range of 1.0 to 14 wt. %.

20. The method in accordance with claim 17 wherein the Mn is in the range of 0 to 0.5 wt. %.

21. The method in accordance with claim 17 wherein the Li is in the range of 2.4 to 2.8 wt. %.

22. The method in accordance with claim 17 wherein the working effect is equivalent to stretching said body an amount greater than 3.6%.

23. The method in accordance with claim 17 wherein the working effect is equivalent to stretching said body 4 to 14%.

24. The method in accordance with claim 17 wherein the working effect is equivalent to stretching said body 4 to 8%.

25. The method in accordance with claim 17 including homogenizing a body of said alloy at a temperature in the range of 900° to 1050° F. prior to forming into said product.

26. Method of making aluminum base alloy products having combinations of improved strength and fracture toughness, the method comprising the steps of:

(a) providing a lithium-containing aluminum base alloy product consisting essentially of 2.2 to 3.0 wt. % Li, 0.4 to 2.0 wt. % Mg, 0.2 to 1.6 wt. % Cu, 0 to 2.0 wt. % Mn, 0 to 0.2 wt. % Zr, 0.5 wt. % max. Fe, 0.5 wt. % max. Si, the balance aluminum and incidental impurities, the product having imparted thereto, prior to an aging step, a working effect equivalent to stretching so that after an aging step the product has improved combinations of strength and toughness; and (b) imparting to said product, prior to an aging step, a working effect equivalent to stretching said product an amount greater than 3% and aging said product to provide improved combinations of strength and fracture toughness.

27. The method according to claim 26 wherein said wrought product is stretched 4 to 12%.

28. The method according to claim 26 wherein said wrought product is stretched 4 to 8%.

29. An aluminum base alloy wrought product suitable for aging and having improved combinations of strength and fracture toughness in responae to an aging treatment while maintaining high levels of resistance to corrosion, the product consisting essentialIy of 2.2 to 2.8 wt. % Li, 1.0 to 1.4 wt. % Mg, 0.3 to 0.8 wt. % Cu, 0 to 0.2 wt. % Zr, 0 to 0.5 wt. % Mn, 0.5 wt. % max. Fe. 0.5 wt. % max. Si, the balance aluminun and incidental impurities, the product having imparted thereto, prior to an said aging, a working effect equivalent to stretching an amount 4 to 12% at room temperature aging said product to provide improved combinations of strength and fracture toughness.

30. An aluminum base alloy wrought product having improved resistance to exfoliation corrosion and suitable for aging and having the ability to develop improved combinations of strength and fracture toughness in response to an aging treatment while maintaining high levels of resistance to corrosion, the product consisting essentially of 2.2 to 2.8 wt. % Li, 1.0 to 1.4 wt. % Mg, 0.3 to 0.8 wt. % Cu, 0.01 to 0.2 wt. % Zr, 0 to 0.5 wt. % Mn, 0.5 wt. % max. Fe, 0.5 wt. % max. Si, the balance aluminum and incidental impurities, the product, prior to an aging step, stretched 4 to 12% aging said product to provide improved strength level without a substantial decrease in fracture toughness.

* * * * *